US012747641B2

(12) United States Patent
Dai et al.

(10) Patent No.: US 12,747,641 B2
(45) Date of Patent: Sep. 29, 2026

(54) ELECTRO-MECHANICAL DISCONNECT MECHANISM

(71) Applicant: Schlumberger Technology Corporation, Sugar Land, TX (US)

(72) Inventors: Wei Dai, Sugar Land, TX (US); Alyssa Ellis, Sugar Lang, TX (US); Majid Salesi, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 125 days.

(21) Appl. No.: 18/949,211

(22) Filed: Nov. 15, 2024

(65) Prior Publication Data

US 2026/0139553 A1 May 21, 2026

(51) Int. Cl.
*E21B 17/06* (2006.01)

(52) U.S. Cl.
CPC ..... *E21B 17/06* (2013.01)

(58) Field of Classification Search
CPC ..... E21B 17/02; E21B 17/06; E21B 19/16; E21B 23/00; E21B 23/02
See application file for complete search history.

(56) References Cited

U.S. PATENT DOCUMENTS

2004/0134667 A1* 7/2004 Brewer ..... E21B 17/023 166/242.6
2006/0278388 A1* 12/2006 Zanca ..... E21B 17/023 166/242.6
2013/0118762 A1* 5/2013 Kellner ..... E21B 23/00 166/386
2024/0254845 A1* 8/2024 Varkey ..... E21B 23/01

* cited by examiner

*Primary Examiner* — Kristyn A Hall
(74) *Attorney, Agent, or Firm* — Jeffrey D. Frantz

(57) ABSTRACT

The invention relates to a downhole system incorporating an electromagnetic disconnect (EMD). The EMD features an actuator rod, a latch mechanism, and a magnetic solenoid, enabling controlled and selective electrical and/or mechanical disconnect of downhole tools. When activated by an electric current, the solenoid triggers the retraction of spring-loaded components, allowing the actuator rod to disengage from the latch. This allows the latch fingers to contract, and when coupled with an electrical connector interface, will disrupt the electrical continuity within the downhole system. Also, the finger contraction will allow for the mechanical disconnect, releasing the tool from the EMD. The mechanism is reusable, allowing for multiple cycles of engagement and disconnect. The system enhances operational efficiency and safety by providing precise control over tool deployment and retrieval in complex wellbore environments.

20 Claims, 5 Drawing Sheets

ELECTRO-MECHANICAL DISCONNECT MECHANISM

BACKGROUND

Field

The present invention relates to downhole assemblies, with the potential to obtain an electromechanical disconnect (EMD) through the use of the described art.

Description of the Related Art

Downhole operations are crucial in the oil and gas industry. Downhole operations involve the use of downhole tools for tasks such as logging, perforating, and setting or retrieving downhole equipment. A critical component in these operations is a release disconnect mechanism, which enables the selective mechanical disconnect of tools or equipment.

One example of a mechanical disconnect used today is an electronically controlled release device (ECRD), which uses a heat element-based release mechanism to perform the mechanical release of the tool. These mechanisms rely on a heat element to melt a fusible link, thereby triggering the release. However, this method has significant limitations. Once the heat element is activated, it cannot be reset, requiring the replacement of the entire release mechanism. The destruction of the fusible link upon activation renders the mechanism unusable for future operations. Another issue with the heat element-based release is that it takes an extended amount of time to perform the operation and requires significant energy to perform the release. Due to the way this mechanism is made, manufacturing process also introduced variability in the assembly which can lead to integrity issues and uncertainty in the mechanism performance. Additionally, the release process is not easily controllable, leading to potential reliability issues in precise release applications.

Another category of downhole release mechanisms are the motorized release systems. These systems use electric motors to drive the mechanisms that allow for the electromechanical disconnect operation within the tool. While they offer some advantages over the heat element-based mechanisms, they introduce new challenges. For example, motorized systems are inherently more complex, leading to increased manufacturing costs and potential points of failure. The complexity extends to field operations, where troubleshooting and maintenance become more difficult and time-consuming. The intricate nature of motorized mechanisms can also compromise reliability in harsh downhole environments.

There is a need in the field for an improved release mechanism that overcomes the limitations of current heat element-based and motorized systems. Specifically, there is a demand for a mechanism that is resettable, reusable, and provides better control over the release process without adding undue complexity to the system.

SUMMARY

Disclosed herein is a downhole system featuring a sophisticated electromechanical release mechanism. This release mechanism is a key innovation, designed to enable controlled and selective disengagement of downhole tools, enhancing operational safety and flexibility during wellbore operations.

One example of the disclosed EM release mechanism utilizes an actuator rod to couple an EM actuator to the release mechanism. This rod is designed with a wide portion and a thin portion, which interact with a latch mechanism that secures the tool in place during use. The latch is composed of flexible fingers equipped with collars, which naturally tend to move inward but are held in an outward position by the wide portion of the actuator rod when the disconnect is engaged. This configuration ensures that the latch remains securely engaged with the housing, preventing any unintended tool release.

The disengagement process is initiated by sending voltage or current to an EM actuator. One example is a solenoid which performs linear actuator in response to electromagnetic excitation. In this example (FIG. 2) when energized, the actuator rod will generate a linear displacement which in turn will trigger the spring pin, causing spring balls within the actuator rod to retract. This action releases the actuator rod, allowing the release of the compressive force of the spring within the system to push the rod axially away from the latch. As the rod moves, the wide portion is withdrawn from the latch fingers, eliminating the outward force that had kept the fingers engaged with the housing notches.

In this specific application, once the actuator rod has fully retracted, the latch fingers are free to move inward due to their natural bias, disengaging from the housing notches. This inward movement of the fingers removes the mechanical support holding the collet inside the system. This allows the latch to be removed, thereby generating a mechanical disconnect within the downhole assembly. The force generated by the EM actuator is precisely controlled by the input voltage and current, ensuring that the release and the required force is achieved, thus providing a high level of control over downhole release operations.

The described EM release mechanism offers significant advantages in downhole environments, where the ability to selectively and safely release tools is critical. By employing an EM actuator controlled system, the energy that is required is significantly reduced when compared to a motorized or heat element based system. This is advantageous in situation where the power budget is limited during a desired release event, for example when there is a short downhole. This EM device also ensures that tool disengagement is both reliable and responsive to operator commands, reducing the risk of accidental releases and improving overall mechanical disconnect effectiveness. Furthermore, the release mechanism is designed to be reusable, resettable and re-engaged after each use, ensuring reliable operation over multiple deployment cycles. Since the actuator force can be controlled, this EM device is also testable and can provide diagnostic feedback on the integrity of the release system. This is a major enhancement to current heat element-based or motorized release mechanisms since this allows for the surface operator to receive live readings on the system health before release and have a clear confirmation that the release has been performed.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

In the following description, numerous details are set forth to provide an understanding of some embodiments of the present disclosure in one specific use case. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which downhole operations are initiated as being the top point and the total depth being the lowest point, wherein the well (e.g., wellbore, borehole) is vertical, horizontal or slanted relative to the surface.

Figure 1:
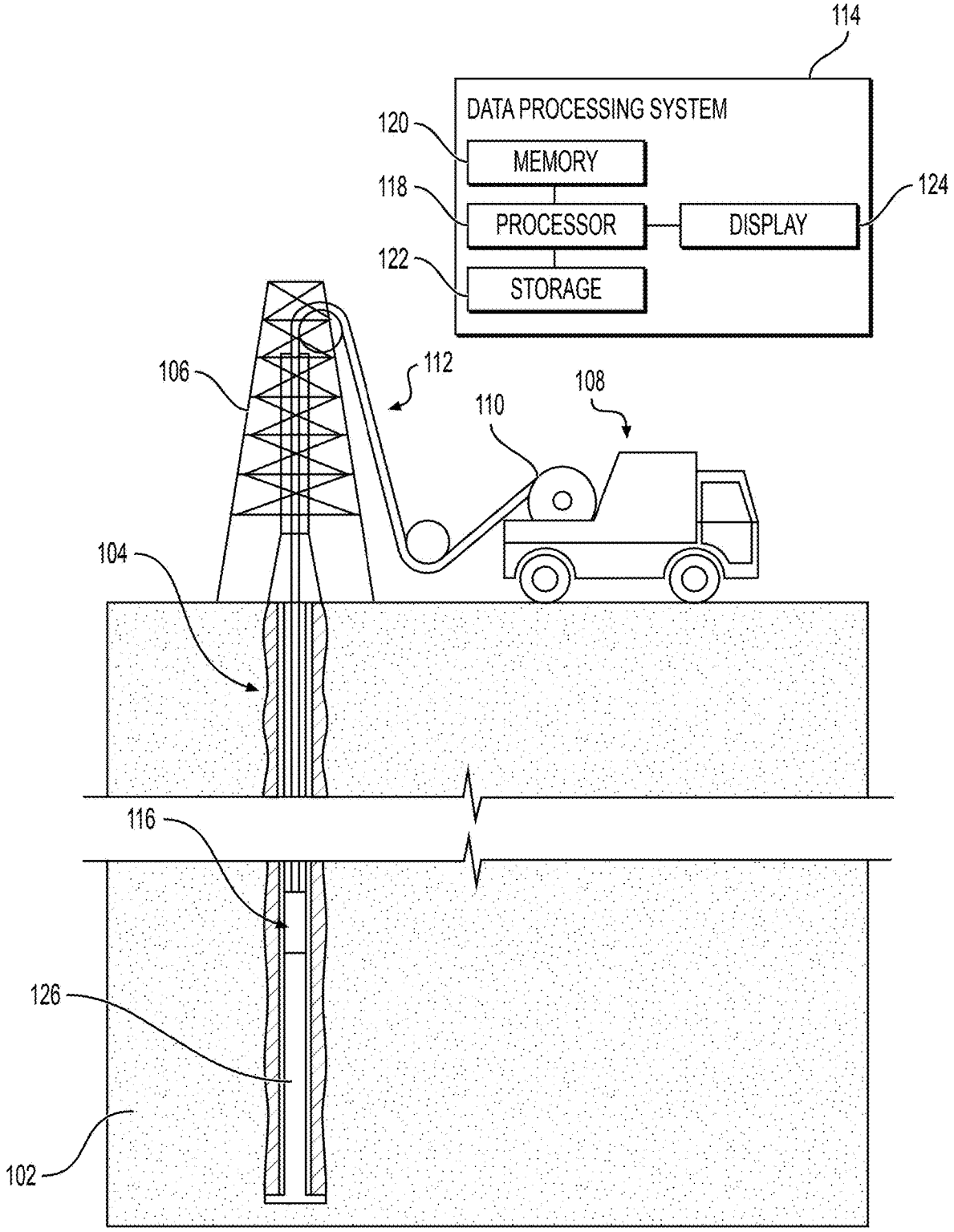
FIG. 1 is a schematic illustration of an example downhole system in which a magnetic release mechanism may be utilized.

FIG. 1 is a schematic illustration of an example downhole system in which a magnetic release mechanism may be utilized. A formation 102 has a drilled and completed wellbore 104. A derrick 106 above ground may be used to raise and lower components into the wellbore 104 and otherwise assist with well operations.

A downhole surface system 108 at the ground level includes a downhole logging unit, a downhole depth control system 110 having a cable 112, and a control unit 114. The cable is connected to a connection assembly 116 that may be lowered downhole. The connection assembly is connected to a tool string 126. The tool string 126 includes one or more downhole tools, such as a perforating device, debris removal tool, and so on. In one example, the tool string can consist of a logging head with an electromagnetic release device located inside.

The control unit 114 includes a processor 118, memory 120, storage 122, and display 124 that may be used to display and control various operations of the downhole surface system 108, send and receive data, and store data.

The connection assembly 116 includes equipment for mechanically and electronically connecting the top of the tool string 126 with the cable 112. The cable 112 includes a support wire, such as steel, to mechanically support the weight of tool string 126 and communication wire to pass communications between the tool string 126 and the downhole surface system 108. The magnetic release mechanism, as described in more detail below, is installed below the connection assembly.

The downhole surface system 108 can deploy the cable 112, which in turn lowers the connection assembly 116 and tool string 126 deeper downhole. Conversely, the downhole surface system 108 can retract the cable 112 and raise the tool string 126 and assembly 116, including to the surface. The cable 112 is deployed or retracted by the downhole depth control system 110, such as by unwinding or winding the cable 112 around a spool that is driven by a motor.

The downhole logging unit communicates with the control unit 114 to send and receive data and control signals. For example, the downhole logging unit can communicate data received from the tool string 126 to the control unit 114. The downhole logging unit likewise can communicate data and control signals received from the control unit 114 to the tool string 126. In some examples, the downhole logging unit is part of the control unit 114. In other examples, the control unit 114 sends and receives data to and from the tool string 126 directly.

Although FIG. 1 shows the tool string 126 being operated on a cable 112, the tool string 126 can be attached to other types of conveyance systems, such as coil tubing. Any conveyance system can be used to mechanically support the tool string 126 and mechanically raise or lower it within the wellbore 104. References to a "cable" are intended to be non-limiting, instead encompassing any known conveyance system.

Figure 2:
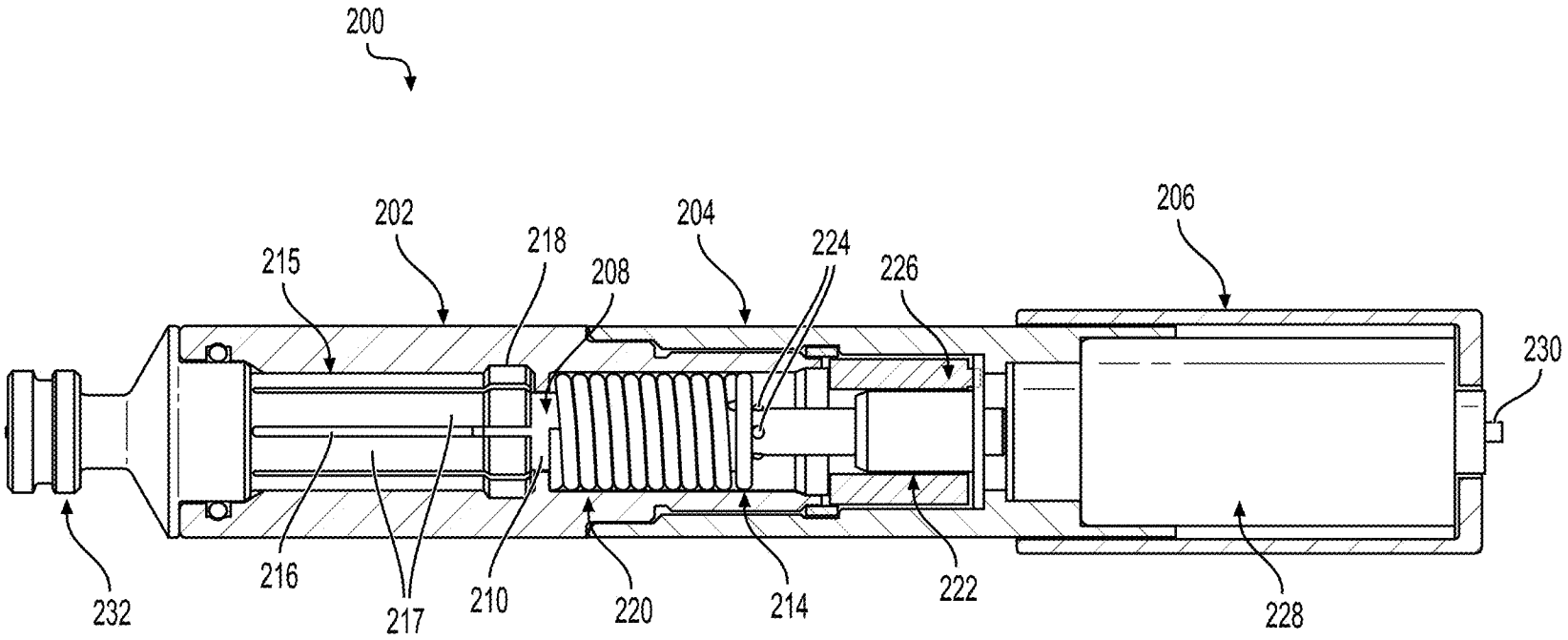
FIG. 2 is an illustration of an example electrically controlled release device with a magnetic release mechanism in an engaged position.

FIG. 2 is an illustration of an example EMD 200 with a magnetic release mechanism in the engaged position. The EMD 200 can include multiple housings coupled to each other. For example, the EMD 200 can include an upper housing 202, a middle housing 204, and a lower housing 206. Using multiple housings can allow for easier assembly and maintenance of components inside the housings 202, 204, 206. However, in some examples, the EMD 200 can include a single housing, two housings, or more than three housings.

An actuator rod 208 can be positioned within a cavity of the housings 202, 204, 206. The actuator rod 208 can be cylindrically shaped and axially aligned with the housings 202, 204, 206. The actuator rod 208 can include a wide portion 210, a thin portion 212, and a collar 214. While the EMD 200 is engaged, the thin portion 212 and a portion of the wide portion 210 can be nested inside a cavity of a latch 215. The latch 215 can include slits 216 that separate flexible "fingers" 217. Each finger 217 can include a collar 218.

The latch 215 can be manufactured in a way that causes the fingers 217 to naturally move inward. However, while the EMD 200 is in an engaged position, the actuator rod 208 can be inserted into the latch 215 so that the wider portion 210 of the actuator rod 208 is nested inside the latch 215. While in this position, the actuator rod 208 exerts an outward radial force on the fingers 217, thereby causing the collars 218 to sit inside a notch 219 (See FIG. 5) of the upper housing 202. This prevents axial movement of the latch 215. The latch 215 can be coupled to or include an adapter 232. The adapter can be coupled to a downhole tool in the tool assembly.

Coils of a spring 220 can wind around the wider portion 210 of the actuator rod 208 between the latch 215 and the collar 214. The spring 220 can be a type of spring that exerts a compressive or tensile force, such as a helical or coil spring. While the EMD 200 is engaged, the spring 220 can exert a compressive force on the collar 214 in the axial direction away from the latch 215. A spring pin 222 can prevent the spring 220 from expanding and consequently extending away from the latch 215. Spacer inserts 226 can be used to hold the spring pin 222 in place during mechanism assembly.

One end of the spring pin 222 can pass through an interior cavity of the actuator rod 208. This is illustrated in greater detail in FIG. 4. The spring pin 222 can include one or more spring balls 224 that function to keep the actuator rod 208 in place. The EMD 200 can include a magnetic solenoid 228 that functions as the electromechanical mechanism to disengage the EMD 200. For example, to disengage the EMD 200, a current can be sent through a wire 230 connected to the magnetic solenoid 228.

Figure 3:
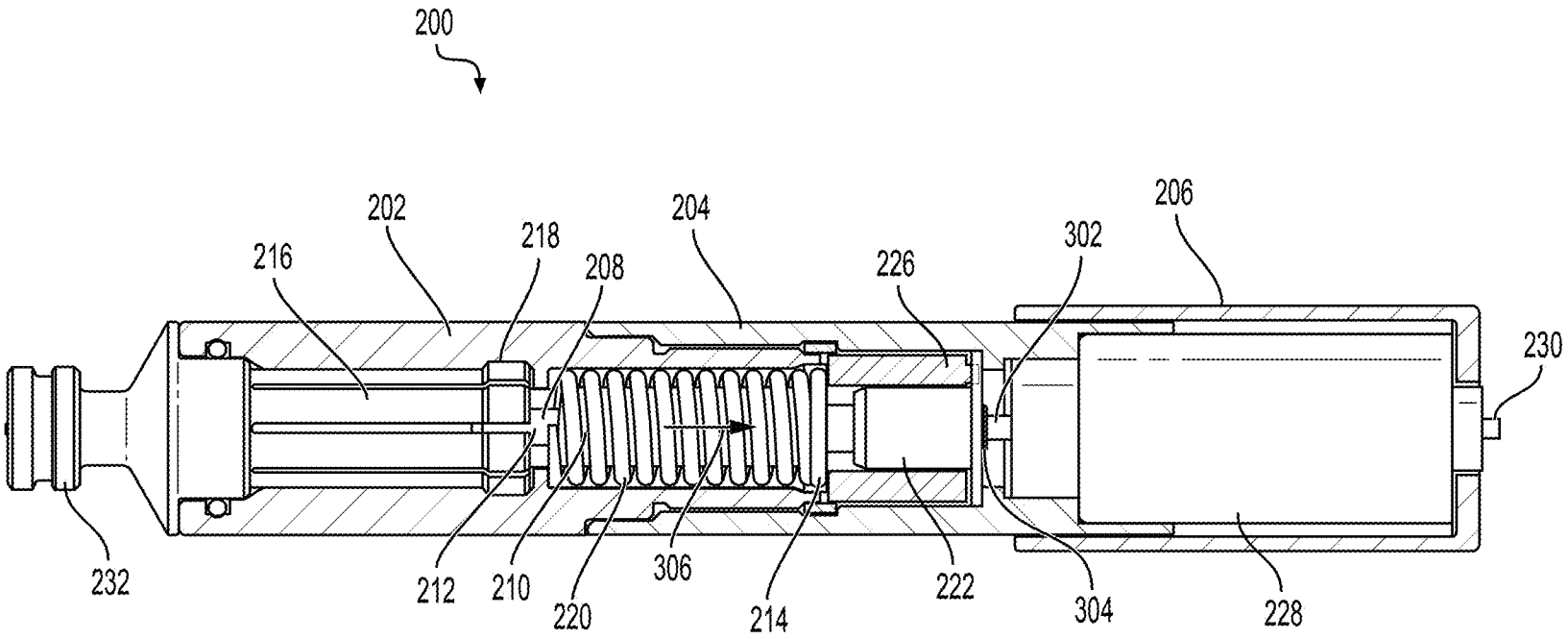
FIG. 3 is an illustration of an example electrically controlled release device with a magnetic release mechanism during disengagement.

FIG. 3 is an illustration of the magnetic release mechanism 200 during disengagement. An electric current passing through the solenoid 228 can cause the solenoid to extend a rod 302. This rod 302 presses a release button 304 on the spring pin 222 that in turn causes the spring balls 224 to retract. This releases the hold on the actuator rod 208. As a result, the compression force from the spring 220 causes the actuator rod 208 to move in the axial direction shown by arrow 306. As shown in FIG. 3, this movement causes the wider portion 210 of the actuator rod 208 to move away from the latch 215.

Figure 4:
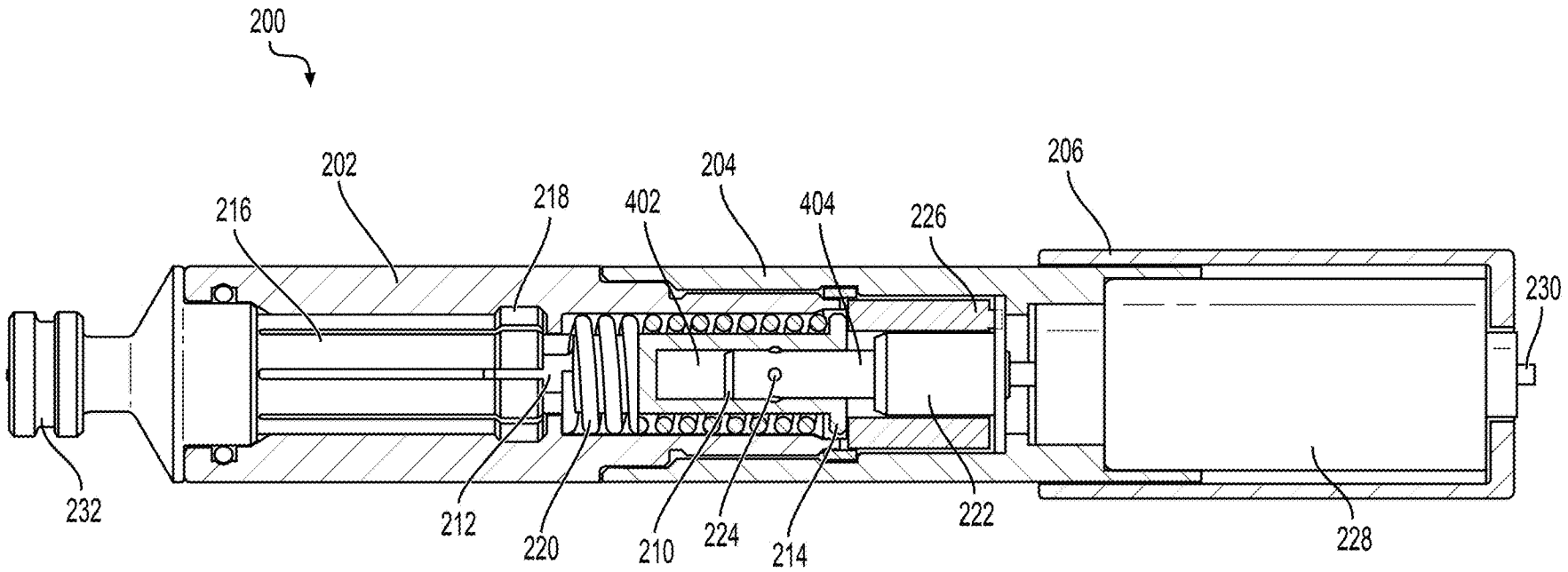
FIG. 4 is an illustration of an example electrically controlled release device with a cross section of a magnetic release mechanism during disengagement.

FIG. 4 is an illustration of a cross section of portions of the EMD 200 during disengagement. As shown, the wider portion 210 of the actuator rod 208 can include a cavity 402 that a thin portion 404 of the spring pin 222 passes through. The external diameter of the thin portion 404 can be the same or slightly less than the internal diameter of the cavity 402. This allows the protruding spring balls 224 to prevent the thin portion 404 from entering further into the cavity 402. However, when the solenoid 228 is activated, causing the spring balls 224 to retract, the actuator rod 208 is free to extend away from the latch 215.

Figure 5:
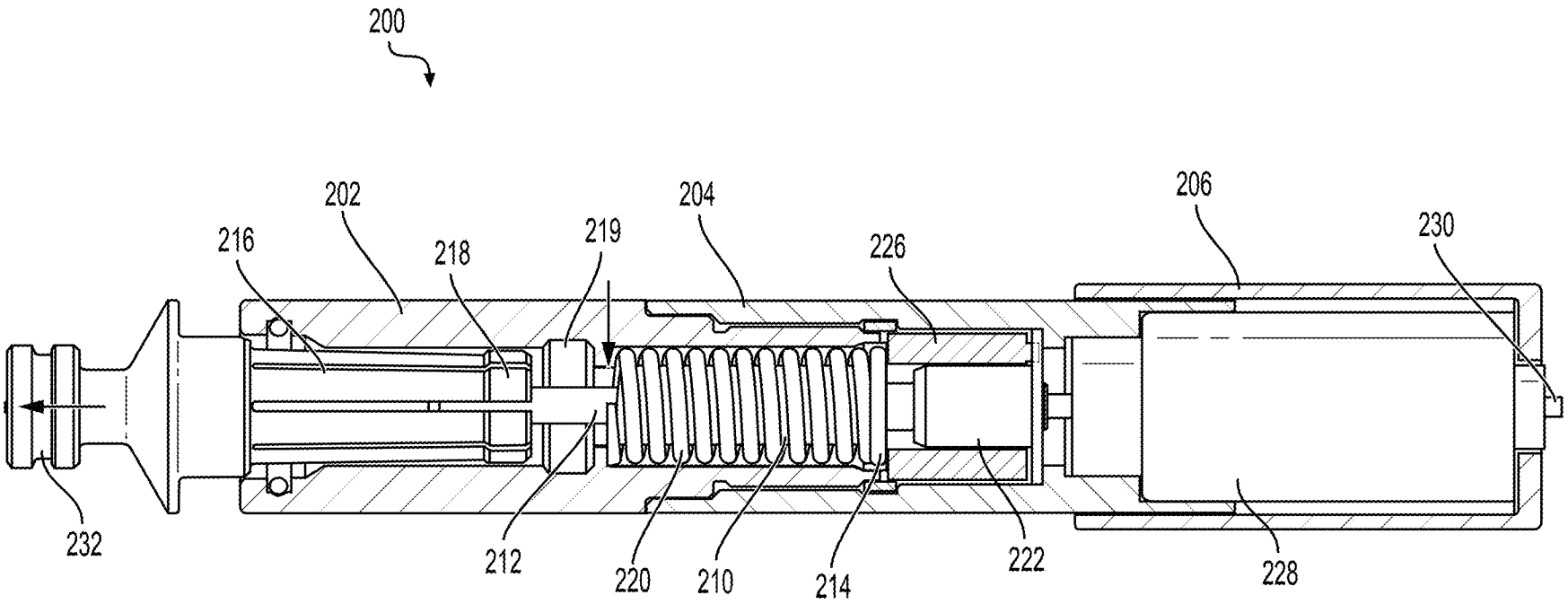
FIG. 5 is an illustration of an example electrically controlled release device with a magnetic release mechanism in a disengaged position.

FIG. 5 is an illustration of the magnetic release mechanism 200 in a disengaged position. As shown in FIG. 5, when the actuator rod 208 has fully extended away from the latch 215, no portion of the wider portion 210 of the actuator rod 208 is in contact with the fingers 217 of the latch 215. As described previously, the fingers 217 are manufactured to naturally move or bow inward. As a result, the collars 218 contract toward each other so that the collars no longer engage with the notches 219. The latch 215 is then free to be removed entirely from the EMD 200.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A release device, comprising:

a housing;

an actuator rod inside the housing, the actuator rod having a thin portion, a wide portion, and a first collar, wherein the wide portion includes an interior cavity;

a latch having a plurality of fingers, each of the plurality of fingers having a second collar;

a spring wound around the actuator rod, wherein the spring exerts an axial force on the actuator rod away from the latch;

a spring pin having a plurality of protruding spring balls and a release mechanism, wherein a portion of the spring pin is nested inside the interior cavity of the wide portion of the actuator rod; and a solenoid that, when activated, extends a protrusion into the release mechanism causing the latch to release.

2. The release device of claim 1, wherein, in an engaged position, the wide portion of the actuator rod is positioned between the plurality of fingers such that the second collars are forced outward radially into a notch of the housing, thereby preventing axial movement of the latch within the housing.

3. The release device of claim 1, wherein activating the solenoid causes the solenoid to extend the actuator rod into a release button, which causes the spring balls to retract, which causes the spring to move the actuator rod radially away from the latch, which causes the plurality of fingers to contract away from notches of the housing and release the latch.

4. The release device of claim 1, wherein the spring is a helical coil spring that exerts a compressive force on the first collar of the actuator rod.

5. The release device of claim 1, wherein the housing comprises an upper housing, a middle housing, and a lower housing, each coupled together to enclose the actuator rod, latch, spring, spring pin, and solenoid.

6. The release device of claim 1, wherein the second collar on each of the plurality of fingers engages with notches in the housing to prevent axial movement of the latch when the release device is engaged.

7. The release device of claim 1, wherein the solenoid is connected to an electrical wire that transmits an electric current to activate the solenoid, thereby extending the protrusion into the release mechanism.

8. The release device of claim 1, wherein the interior cavity receives a thin portion of the spring pin, and the plurality of spring balls protrude outwardly to engage the interior cavity of the wide portion of the actuator rod.

9. The release device of claim 1, wherein the plurality of fingers of the latch are naturally biased to move inward, allowing the second collar to disengage from notches in the housing when the solenoid is activated.

10. The release device of claim 1, wherein the solenoid and release mechanism are configured to allow for the reuse of the release device by enabling the actuator rod to be re-engaged with the latch after each use.

11. A downhole system for downhole operations, comprising:

a downhole surface system including a control unit and a depth control system, wherein the depth control system deploys and retracts a cable;

a connection assembly coupled to the cable, the connection assembly including mechanical and electronic connections for interfacing with downhole tools;

a tool string connected to the connection assembly, the tool string including an electromechanical disconnect (EMD), wherein the EMD comprises:

a housing;

an actuator rod inside the housing, the actuator rod having a thin portion, a wide portion, and a first collar, wherein the wide portion includes an interior cavity;

a latch having a plurality of fingers, each of the plurality of fingers having a second collar;

a spring wound around the actuator rod, wherein the spring exerts an axial force on the actuator rod away from the latch;

a spring pin having a plurality of protruding spring balls and a release mechanism, wherein a portion of the spring pin is nested inside the interior cavity of the wide portion of the actuator rod; and a solenoid that, when activated by an electric current from the control unit, extends a protrusion into the release mechanism causing the latch to release.

12. The system of claim 11, wherein, in an engaged position, the wide portion of the actuator rod is positioned between the plurality of fingers such that the second collars are forced outward radially into a notch of the housing, thereby preventing axial movement of the latch within the housing.

13. The system of claim 12, wherein activating the solenoid causes the solenoid to extend the actuator rod into a release button, which causes the spring balls to retract, which causes the spring to move the actuator rod radially away from the latch, which causes the plurality of fingers to contract away from the notch of the housing and release the latch, and wherein releasing the latch causes at least one component of the tool string to disconnect from the tool string.

14. The system of claim 11, wherein the spring is a helical coil spring that exerts a compressive force on the first collar of the actuator rod.

15. The system of claim 11, wherein the housing comprises an upper housing, a middle housing, and a lower housing, each coupled together to enclose the actuator rod, latch, spring, spring pin, and solenoid.

16. The system of claim 11, wherein the second collar on each of the plurality of fingers engages with notches in the housing to prevent axial movement of the latch when the EMD is engaged.

17. The system of claim 11, wherein the solenoid is connected to an electrical wire that transmits an electric current to activate the solenoid, thereby extending the protrusion into the release mechanism.

18. The system of claim 11, wherein the interior cavity receives a thin portion of the spring pin, and the plurality of spring balls protrude outwardly to engage the interior cavity of the wide portion of the actuator rod.

19. The system of claim 11, wherein the plurality of fingers of the latch are naturally biased to move inward, allowing the second collar to disengage from notches in the housing when the solenoid is activated.

20. The system of claim 11, wherein the solenoid and release mechanism are configured to allow for the reuse of the EMD by enabling the actuator rod to be re-engaged with the latch after each use.

* * * * *